US007886504B2

(12) United States Patent
Mühlemann

(10) Patent No.: US 7,886,504 B2
(45) Date of Patent: Feb. 15, 2011

(54) METHOD FOR PLACING A CAPSULE ONTO THE NECK OF A PLASTIC BOTTLE WHEN FILLING THE BOTTLE

(75) Inventor: Rolf Mühlemann, Schlattingen (CH)

(73) Assignee: RM Beteiligungs AG, Stein am Rhein (CH)

( * ) Notice: Subject to any disclaimer, the term of this patent is extended or adjusted under 35 U.S.C. 154(b) by 643 days.

(21) Appl. No.: 11/791,440

(22) PCT Filed: Oct. 26, 2005

(86) PCT No.: PCT/CH2005/000596

§ 371 (c)(1),
(2), (4) Date: May 22, 2007

(87) PCT Pub. No.: WO2006/056082

PCT Pub. Date: Jun. 1, 2006

(65) Prior Publication Data

US 2008/0006599 A1 Jan. 10, 2008

(30) Foreign Application Priority Data

Nov. 26, 2004 (CH) ..... 1947/04
Aug. 30, 2005 (CH) ..... 1415/05

(51) Int. Cl.
*B65B 61/00* (2006.01)

(52) U.S. Cl. ..... 53/423; 53/410; 53/420; 53/425; 53/474; 53/488; 53/130.1; 53/173

(58) Field of Classification Search ..... 53/410, 53/420, 423, 425, 467, 474, 484–486, 488, 53/155, 130.1, 137.1, 170, 173
See application file for complete search history.

(56) References Cited

U.S. PATENT DOCUMENTS 2,631,521 A * 3/1953 Atkins ..... 99/275
3,305,368 A * 2/1967 Bourelle ..... 426/120
3,779,372 A * 12/1973 de Lloret ..... 206/222
5,224,601 A * 7/1993 Gouge et al. ..... 206/524.7
5,370,222 A * 12/1994 Steigerwald et al. ..... 206/222
5,799,775 A * 9/1998 Spring ..... 206/222

(Continued)

FOREIGN PATENT DOCUMENTS

EP 0 857 662 A1 8/1998

(Continued)

*Primary Examiner*—Christopher Harmon
(74) *Attorney, Agent, or Firm*—Pauley Petersen & Erickson

(57) ABSTRACT

A container with a corresponding bottle neck having a capsule inside of which a substance is placed that is to be released into the bottle contents. This invention avoids having to sterilize the contents again after the container has been aseptically filled, even though the substance in the capsule often does not endure these temperatures. Thus, this invention provides a method with the following steps: a) aseptic filling of the plastic bottle; b) welding a first membrane onto the container neck; c) placing the substance, which is to be released into the plastic bottle, on the first membrane that is already welded on; d) covering the substance, which is to be released, by a second membrane and welding the second membrane to the first membrane. Lastly, a closure with a secured tamper-evident layer is placed over the capsule and onto the bottle neck.

10 Claims, 2 Drawing Sheets

U.S. PATENT DOCUMENTS

| | | | | |
|---|---|---|---|---|
| 5,884,759 | A | 3/1999 | Gueret | |
| 5,992,677 | A * | 11/1999 | Ebine | 220/505 |
| 6,105,760 | A * | 8/2000 | Mollstam et al. | 206/222 |
| 6,513,650 | B2 * | 2/2003 | Mollstam et al. | 206/222 |
| 6,786,330 | B2 * | 9/2004 | Mollstam et al. | 206/222 |
| 7,077,291 | B1 * | 7/2006 | Bell et al. | 222/83 |
| 7,562,771 | B2 * | 7/2009 | Fontana | 206/222 |
| 2004/0161504 | A1 * | 8/2004 | Daniels et al. | 426/115 |

FOREIGN PATENT DOCUMENTS

| | | | |
|---|---|---|---|
| GB | 2 210 014 | A | 6/1989 |
| GB | 2 321 231 | A | 7/1998 |
| GB | 2 364 699 | A | 2/2002 |
| WO | WO 98/40289 | | 9/1998 |

* cited by examiner

METHOD FOR PLACING A CAPSULE ONTO THE NECK OF A PLASTIC BOTTLE WHEN FILLING THE BOTTLE

BACKGROUND OF THE INVENTION

1. Field of the Invention

This invention relates to a method for filling a plastic bottle with a neck, and the attachment of a capsule with at least one substance which is enclosed therein and which is to be dispensed into the plastic bottle, as well as to a plastic bottle with a capsule attached on the bottle neck.

2. Discussion of Related Art

As known, many mixed products separate, decompose or change in another manner and thus become unusable after a certain period of time. This is circumvented by storing certain substances which break down easily, separately, and leaving it to the consumer to bring together the components before the actual use. This is the case with different medicaments, with which a powdery substance or a tablet is added to a liquid component, and these two parts are taken together afterwards. This concept is becoming more widespread in the foodstuffs industry. Thus for example, fruit yogurts are offered, which are accommodated in a two-part pot, wherein the yogurt is accommodated in one pot and the crunchy muesli in the other pot, and the muesli pot may be moved in a hinged manner and the contents may be emptied into the yogurt pot after the removal of a cover membrane. Because the two components may be consumed on their own without any problem, it is also not a problem for the consumer to have both parts individually accessible. With milk mixing products, for example, the fluid component obtained from milk is present with other substances, such as various vitamins, trace elements or other components which are beneficial to health, and it does not make sense for the consumer to have these two parts separate.

Accordingly, plastic bottles which are combined with a capsule in which a substance to be applied into the plastic bottle is held, have been obtainable on the market. One particular known embodiment is taught by PCT International Publication WO 98/40289. Here, a tablet is located in a cavity of a closure which is closed by a lid. On opening for the first time, this lid is pierced and the tablet falls into the container. This solution is inadequate for reasons of demands with regard to shelf-life and hygiene, because the tablet is not present sealed in a separate capsule. In a second variant, the tablet is located in a capsule and is removed using a breakthrough means, and falls into the liquid component located thereunder. Because the capsule remains in the pour-out region of the closure, the closure must be screwed off after opening for the first time, and the capsule removed. This is awkward for the consumer and is probably not understood. The consumer would become irritated because of the poor pour-out nature of the closure.

Apart from these mentioned documents which represent the closest state of the art, other possible concepts which indicate a chamber in a closure, in which the tablet is accommodated in a direct manner or in an enclosure which may be pierced. Such documents for example are Great Britain Patent References GB-A-2'321'231 or GB-A-2'364'699.

Great Britain Patent Reference GB-A-2'210'014 shows a completely different idea, a water beaker which is filled with water, in order to consume tablets located in a blister package arranged above the beaker. Finally, European Patent Reference EP-0'857'662 shows an unusual solution with which a container or its lid that comprises a secondary closure, which may be used by a filling machine for filling a receptacle in a cold-aseptic manner.

The solutions with regard to known closure and receptacles, wherein a capsule with a substance is held over the container neck, always assume that these capsules need to be removed after having been emptied, in order to bring the container with the closure into a condition of use. The applicant distances himself from this concept, and is aware of the fact that a capsule with a substance accommodated therein which is to be introduced into the fluid of the receptacle, represents an enormous potential, but that this potential may only be exploited if the capsule may be attached onto the receptacle during the filling procedure in a manner which is conducive to production. A known solution filed previously by the applicant discloses welding a finished capsule directly onto the bottle neck and dimensioning the capsule and bottle neck accordingly. However, for various applications, such a solution is hardly possible logistically in a reasonable manner, in particular when one operates with very high filling speeds.

A further problem is that often, the fluid accommodated in the receptacle, if a drink, must also be sterilized after the aseptic filing. However, temperatures which under certain circumstances would already destroy the contents of the capsule already located on the bottle occur during sterilization.

Because the receptacle is closed with the capsule, it is not possible to sterilize before applying the capsule. These problems often occur with fruit juices or drinks produced using milk.

SUMMARY OF THE INVENTION

It is one object of this invention to provide a method for filling a plastic bottle with a neck, and an attachment of a capsule with at least one substance enclosed therein and to be dispensed into the plastic bottle, which is suitable for filling installations with very high speeds and is also suitable for filling fluids to be sterilized in the bottle.

This object is achieved by a method with the features described in this specification and the claims.

It is another object of this invention to provide a plastic bottle with a capsule attached on the bottle neck, which may be realized according to the method described in this specification and the claims. This object is achieved by a plastic bottle with a capsule attached on the bottle neck, with the features described in this specification and the claims.

BRIEF DESCRIPTION OF THE DRAWINGS

The method according to this invention, as well as a plastic bottle filled according to the method and provided with a capsule, are represented schematically in the drawings, wherein.

DESCRIPTION OF THE INVENTION

Figure 1:
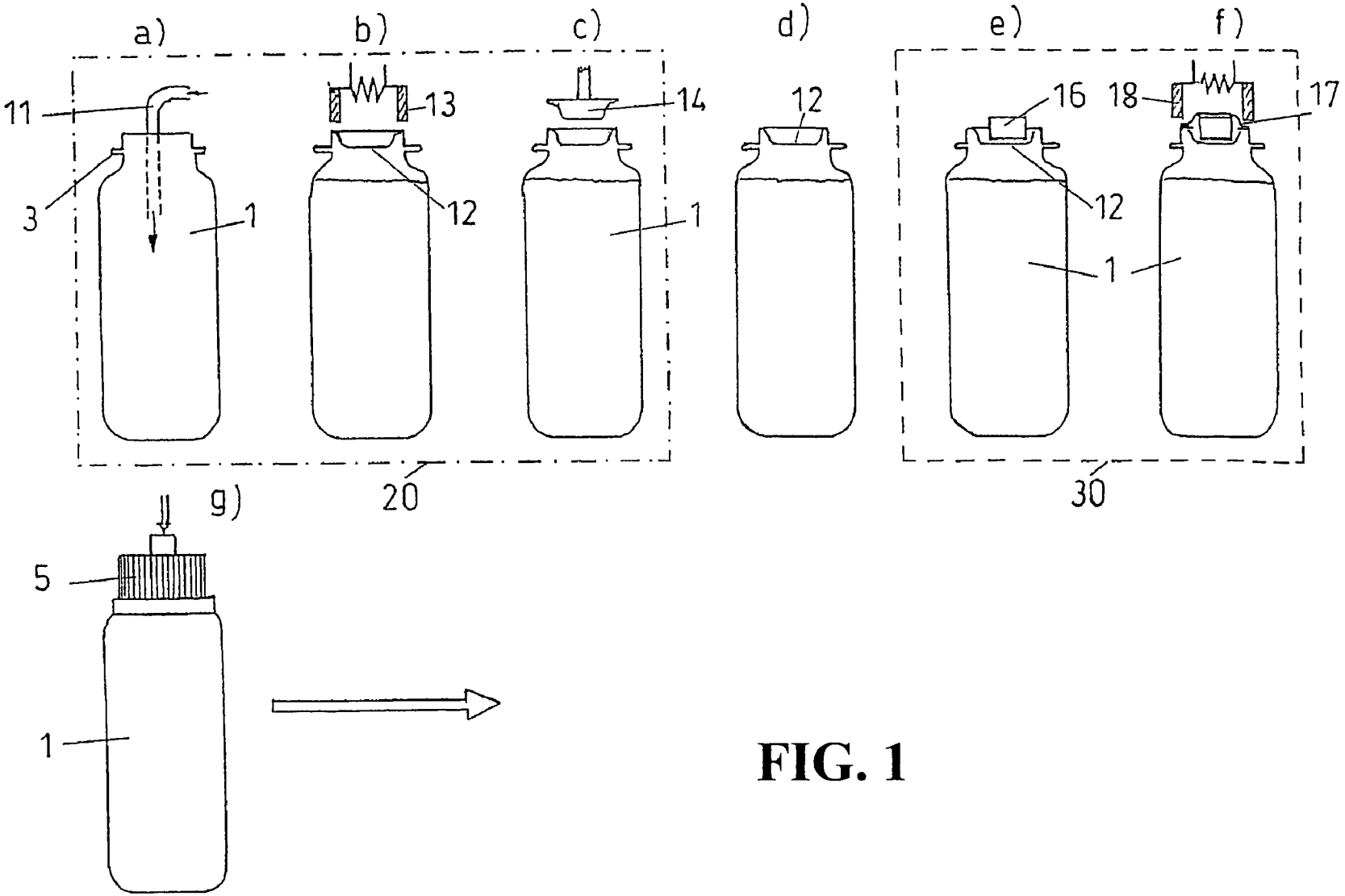
FIG. 1 shows one course of the method of this invention, in part steps a) to g)
Figure 2:
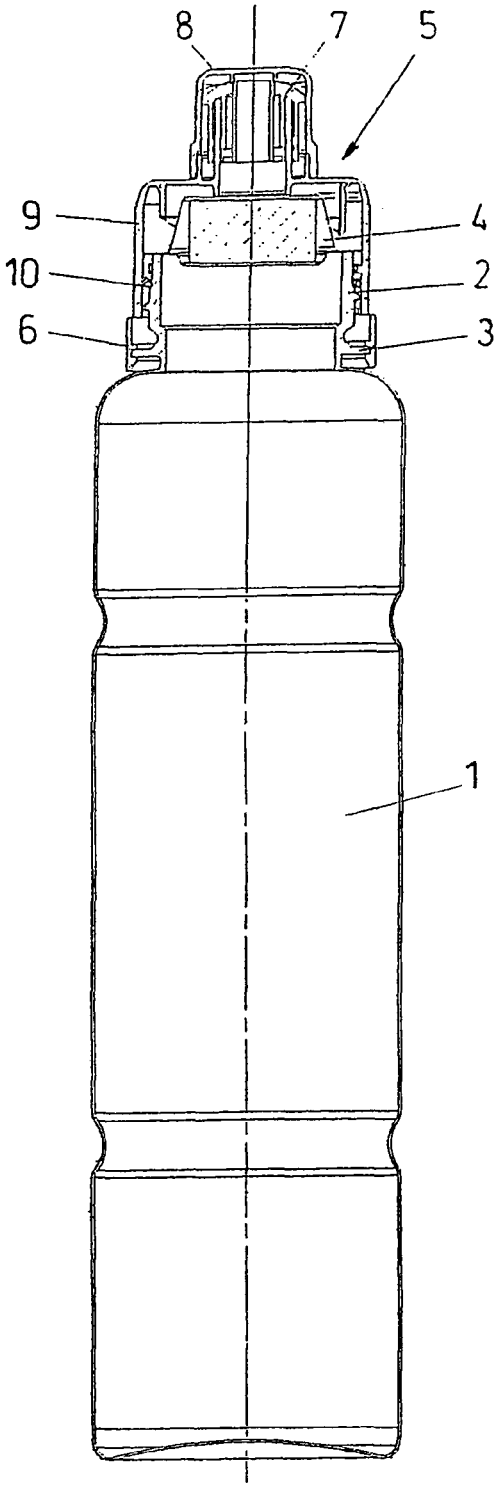
FIG. 2 shows a plastic bottle filled according to the method of this invention, with a capsule attached thereon, and a closure placed on over the capsule, partly in section.

The end product to be obtained comprises a filled plastic bottle with a bottle neck, on which a capsule is placed. The capsule contains a substance to be dispensed which may be in solid form, in tablet form, in powder form or even in liquid form.

The plastic bottle which in its entirety is indicated at 1, is preferably of plastic, and comprises a bottle neck 2. A collar 3 is integrally formed on the bottle neck 2 peripherally on the outside. The collar which is present is not relevant to the actual method. A capsule which in its entirety is indicated at 4 is welded on the bottle neck 2. A closure 5 is placed on over the welded-on capsule 4. The closure 5 comprises a guarantee strip 6 which encompasses the collar 3. The closure 5 includes a drinking spout 7 which may be closed with a sealing cap 8. The closure 5 has a skirt 9 with an inner thread 10. The closure 5 may be screwed on from the integrity guarantee position represented here, into a position for use. With this, the capsule 4 is pierced and its content gets into the fluid present in the plastic bottle 1. The more detailed design of the closure 5 is not the subject-matter of this invention and its exact design is thus not described.

The method according to this invention is now explained with reference to FIG. 1. The steps a) to c) are surrounded with a dot-dashed frame. This dot-dashed frame schematically represents the fact that these steps are effected in an aseptic chamber 20. The aseptic chamber 20 per se is a closed chamber in a filling installation, and is thus integrated in this installation. In a first step which is indicated in the Figure at a), a filling conduit 11 is introduced into the plastic bottle 1 and this is filled to the desired level with the fluid to be filled. The plastic bottle 1 in a subsequent step is conveyed to a welding station, and there is sealed with a first membrane 12. In principle, the terms welding as well as sealing are to be used in a tantamount manner. In the actual context, a welding of two thermoplastic layers takes place. Accordingly, the membrane is coated on both sides with a layer capable of being sealed. This layer undergoes a thermoplastic welding with the container neck. The membrane itself, which is preferably manufactured of aluminum, is thereby attached on the bottle neck 2 by a sealing. For this, an electrically heatable sealing or welding punch 13 is present in a correspondingly schematic manner, by which the connection of the membrane to the container neck is effected. After this sealing, the plastic bottle 1 is closed in an absolutely sealed manner by way of the first membrane 12. The electrically heated forming punch 14 moves away, and the first membrane 12 may then be yet be brought into its final shape optionally either in a purely mechanical manner or thermal manner. Accordingly, the first membrane 12 may already be attached in its final shape, or be brought into its final shape in the subsequent step in FIG. 1 at c), for example with a heated punch 14.

The plastic bottle 1 which is sealingly closed by the first membrane 12 then leaves the aseptic chamber 20 and now as an optional intermediate step, may be sterilized itself in the container. This intermediate step is represented in FIG. 1 as d). After the sterilization, the filled container which is closed in an absolutely sealed manner, may be intermediately stored before the further steps are effected.

In the next step, the sealed container 1 is then introduced into a dry room 30. The dry room 30 may also be designed simultaneously as a clean room. In this dry room 30, a substance 16 to be introduced into the container is then attached onto the first membrane 12 which is already welded on the bottle neck. As mentioned, the substance 16, as shown here, may be present in tablet form, but it is possible for the substance 16 to be deposited onto the first membrane 12 in powder form or in a liquid, pasty form. The first membrane 12 is designed according to the consistency of the substance to be deposited.

When the substance 16 to be introduced is applied on the first membrane 12, a second membrane 17 is laid thereon. This second membrane 17 may be already pre-shaped. The second membrane 17 may for example be an aluminum film. This aluminum film may be printed, anodized or have another coating which essentially is to meet aesthetic demands. It can be advantageous for this coating to be able to prevent an erosion of the film. The first membrane 12 may have a hot-seal layer in a double-sided manner, the second membrane 17 no longer needs to carry a sealing layer. The second membrane 17 is then applied over the first membrane 12, wherein at least the surfaces of the first and the second membrane which come to lie over the container neck, come to lie over one another in a congruent manner. In the subsequent step, which is represented in the drawing at f), the second membrane 17 is welded onto the first membrane 12. Here too, a suitable electrical welding punch 18 is provided. More preferably, one would design the second membrane 17 roughly equal and opposite to the first membrane 12, so that an inner space arises which is as large as possible. Thus, according to desire, the first membrane may be deep-drawn to a greater extent than the second membrane or vice versa. This can depend on the consistency of the substance which is to be accommodated in the capsule 4 to be filled. If this substance is a liquid, the second membrane may be designed in an absolutely plane manner.

The welding of the membranes 12 and 17 is effected at relatively low temperatures which are harmless to the contents. The temperatures to be selected can depend on the hot-seal coatings attached on the first membrane. The first membrane 12 can be provided on both sides with a hot-seal layer which may be processed at about the same temperature. However, it can be advantageous to provide the first membrane on one side with a low temperature sealing layer and on the other side with a hot-temperature sealing layer. In this case, in the first step one would weld the first membrane 12 with the low-temperature sealing layer on the container neck or bottle neck. The second hot-temperature sealing layer does not participate at this temperature. Accordingly, the second membrane 17 is subsequently welded onto the high-temperature sealing layer at a correspondingly higher temperature. As mentioned, the second membrane 17 is not provided with a hot-seal layer in this case.

Alternatively, it is possible to provide both membranes each with a hot-seal layer. In this case, one would advantageously attach hot-seal layers with different temperature ranges on both membranes. Here, one provides only the first membrane 12 with a hot-seal layer which is welded at a higher temperature, whereas one would then weld the second membrane 17 onto the first membrane at a lower temperature than was previously the case on welding the first membrane 12. Accordingly, the second membrane has a low-temperature sealing layer.

Expressed somewhat more generally, a plastic bottle with a plastic neck with a capsule attached thereon thus arises, wherein at least the first membrane 12 comprises a hot-seal layer for a first temperature range for welding onto the container neck, and a second hot-seal layer which is either arranged on the second side of the first membrane 12 or on a side of the second membrane 17, and is suitable for a second temperature range.

The first membrane 12 as well as the second membrane 17 can be designed in a uni-laminar or multi-laminar manner. The materials from which these membranes may be manufactured are quite numerous. Membranes of aluminum or plastic or a mixture thereof are suitable for deep-drawn or pre-shaped membranes. The same is the case for the second membrane 17, if it is likewise to have a crowned shaped. With a plane membrane, paper films laminated with aluminum are considered. In general, plastic films with vapor-deposited metal are considered. The hot-seal layer in any case is the outer coating.

As soon as the capsule is attached in a finished manner on the container or on the bottle 1, the closure 5 is then attached on this straight away. The capsule is thus protected from mechanical influences by way of this.

A bottle filled according to this method ensures a superior shelf-life capability of the introduced product. The influence of temperature on the substance 16 to be introduced is extremely low because of the relatively low temperatures with which the membranes may be attached and the respective hot-seal coatings. The dry room may be accordingly cooled.

As mentioned, the first membrane may also be a plane membrane. This can be useful if afterwards the active substance to be dispensed into the bottle is deposited in an encapsulated form on this membrane, and thus the second membrane is part of this capsule. This solution can be economically more costly, and may be required for reasons of logistics. In this case, one may provide the first membrane with a hot-seal layer on both sides, wherein it makes sense for the hot-seal layer which comes to lie on the container neck to be a low-temperature sealing layer, while the sealing layer which connects to the second membrane which is part of the capsule is designed for a higher temperature range. This procedure provides a product which is particularly easy to handle with regard to logistics and storage.

One solution which is particularly simple with regard to manufacturing technology and which also requires less investment can result from the diameters of the capsule membranes being larger than the diameter of the bottle neck 2. In this case, the second membrane which is part of the capsule, is centrically placed onto the first membrane, and the closure or a part of a multi-part closure is then pressed on, so that the capsule is held with practically positive on the bottle neck in an edge-flanged manner, and is held in a secure manner by the closure or a closure part. With this assembly type it is possible to manufacture all membranes of aluminum or aluminum composite.

It is to be noted that the numbering of the steps a) to g), represented in FIG. 1, do not correspond to the numbering in the patent claims.

Without explicitly going into detail, the membranes may be designed so that several chambers are formed, and accordingly also different active substances may be dispensed.

The invention claimed is:

1. A method for filling a plastic bottle with a neck and attaching a capsule with at least one enclosed substance to be dispensed into the plastic bottle, the method including steps:

a) aseptic filling the plastic bottle;

b) welding a first membrane onto the neck, wherein the first membrane is thermally deformed one of after welding or on welding, so that at least one receiver shell is formed for the substance to be deposited thereon and dispensed into the bottle;

c) depositing the substance to be dispensed into the plastic bottle, onto the first membrane welded onto the neck;

d) fixing the substance to be dispensed by a further membrane, and connecting the further membrane to one of the first membrane and the bottle neck; and e) attaching a closure on the bottle neck in a secured guarantee position over the formed capsule.

2. A method according to claim 1, wherein the second membrane is deposited as a pre-shaped, curved membrane.

3. A method according to claim 1, wherein the first membrane is a plane membrane and the active substance is indirectly deposited thereon in an encapsulated form, wherein a film of the capsule which comes to lie on the attached membrane is a second membrane for fixing the substance to be dispensed.

4. A method according to claim 3, wherein the further membrane is a second film having a diameter larger than the bottle neck diameter, and by pressing on the closure is held encompassing the bottle neck with a positive fit and is fixed on the bottle neck by one of the closure or the closure part.

5. A method according to claim 4, wherein the further membrane is one of the films for forming the capsule, and the film is one of an aluminum film or a film containing aluminum.

6. A method according to claim 1, wherein after the step b), contents of the sealed bottle is sterilized, and the further steps follow thereafter.

7. A method according to claim 1, wherein at least the steps c) and d) are carried out in a dry room.

8. A method according to claim 1, wherein at least the steps a) to d) are effected at clean room conditions according to foodstuff guidelines.

9. A method according to claim 1, wherein the first membrane on one side has a low temperature sealing layer, and on the other side has a high-temperature sealing layer, wherein the first membrane is welded onto the bottle neck with the low-temperature sealing layer, and then the second membrane is welded onto the high-temperature sealing layer of the first membrane.

10. A method according to claim 1, wherein the first membrane and the second membrane each has a sealing layer for different temperature ranges, wherein the first membrane is welded on at a higher temperature, while the second membrane is welded onto the first membrane at a lower temperature than the first membrane.

* * * * *